US007882719B2

(12) United States Patent
Schulmeister et al.

(10) Patent No.: US 7,882,719 B2
(45) Date of Patent: Feb. 8, 2011

(54) ROLL STAND WITH BACK-UP ROLLS AND/OR WORK ROLLS FOR ROLLING SHEET METAL OR STRIPS

(75) Inventors: Juri Schulmeister, Gummersbach (DE); Markus Wagener, Netphen (DE)

(73) Assignee: SMS Siemag Aktiengesellschaft, Dusseldorf (DE)

( * ) Notice: Subject to any disclaimer, the term of this patent is extended or adjusted under 35 U.S.C. 154(b) by 336 days.

(21) Appl. No.: 12/083,037

(22) PCT Filed: Aug. 30, 2007

(86) PCT No.: PCT/EP2007/007570

§ 371 (c)(1),
(2), (4) Date: Apr. 3, 2008

(87) PCT Pub. No.: WO2008/046469

PCT Pub. Date: Apr. 24, 2008

(65) Prior Publication Data

US 2009/0255311 A1 Oct. 15, 2009

(30) Foreign Application Priority Data

Oct. 18, 2006 (DE) ..... 10 2006 049 161

(51) Int. Cl.
*B21B 27/06* (2006.01)

(52) U.S. Cl. ..... 72/201

(58) Field of Classification Search ..... 72/43, 72/44, 45, 201, 236, 245, 246
See application file for complete search history.

(56) References Cited

U.S. PATENT DOCUMENTS

| | | | | | |
|---|---|---|---|---|---|
| 4,272,976 | A | * | 6/1981 | Pizzedaz | 72/45 |
| 4,671,091 | A | * | 6/1987 | Atack et al. | 72/45 |
| 4,709,568 | A | * | 12/1987 | Ticehurst et al. | 72/201 |
| 4,718,264 | A | * | 1/1988 | Guppy et al. | 72/201 |
| 4,996,858 | A | * | 3/1991 | Stoy et al. | 72/43 |
| 5,046,347 | A | * | 9/1991 | Crosato et al. | 72/201 |
| 5,524,465 | A | * | 6/1996 | Kajiwara et al. | 72/42 |

FOREIGN PATENT DOCUMENTS

| | | |
|---|---|---|
| DE | 100 49 032 | 5/2002 |
| EP | 0 674 953 | 10/1995 |
| GB | 2 111 885 | 7/1983 |
| JP | 61-007009 A | 1/1986 |
| JP | 2000-351008 | 12/2000 |
| KR | 1020040092252 | 1/2001 |
| WO | 03/002277 | 1/2003 |

* cited by examiner

*Primary Examiner*—Edward Tolan
(74) *Attorney, Agent, or Firm*—Lucas & Mercanti, LLP; Klaus P. Stoffel

(57) ABSTRACT

The invention concerns a rolling stand (1) with backup rolls and/or work rolls (2, 3, 4, 5) for rolling plate (6) or strip, with at least one rest bar (8), which is arranged between the work roll chocks (7) and preferably is assigned to the upper roll (3); with an inlet/outlet guide (9) for a medium, e.g., cooling water or the like, arranged next to the rest bar (8); and with sealing means (10) for preventing the medium, e.g., cooling water, from dripping onto the rolling stock. In accordance with the invention, it is provided that the sealing means (10) for preventing the medium, e.g., cooling water, from dripping onto the rolling stock is designed as at least one sealing strip (11) arranged between the rest bar (8) and the inlet/outlet guide (9).

8 Claims, 2 Drawing Sheets

ROLL STAND WITH BACK-UP ROLLS AND/OR WORK ROLLS FOR ROLLING SHEET METAL OR STRIPS

The invention concerns a rolling stand with backup rolls and/or work rolls for rolling plate or strip, with at least one rest bar, which is arranged between chocks of one of the rolls and preferably is assigned to the upper roll, with an inlet/outlet guide for a medium, e.g., cooling water or the like, arranged next to the rest bar, and with sealing means for preventing the medium from dripping onto the rolling stock.

In rolling stands with backup rolls and/or work rolls for rolling plate or strip, there is a basic need to remove media, such as roll cooling water, emulsion, etc., before they drip down between the inlet/outlet guide and the rolls/roll fittings. There are several prior-art arrangements of rolling stands in which sealing devices are provided for this purpose. In most cases, e.g., V-shaped seals, preferably made of rubber, are vertically inserted, but they are subject to increased wear, especially in hot rolling mills. In this regard, the following prior-art documents are cited:

DE 100 49 032 A1 describes a rolling stand with backup rolls and/or work rolls for rolling plate or strip. This rolling stand has a rest bar that is arranged between the work roll chocks and assigned to the upper roll and a water stripper that is mounted on the lower periphery of the roll and on the rest bar and can be adjusted towards the outside against the surface of the roll by adjustment mechanisms. To realize a compact device that occupies a relatively small amount of space, it is proposed that the water stripper, which is formed with a shaped cross section, be guided in a mounting strip, that a cavity that runs in extension of the mounting strip is formed in the water stripper, and that a pressure medium can be admitted into the cavity. In one embodiment, it is provided that the water stripper is elastic and is guided in a groove of the mounting strip. It is also provided that the mounting strip is connected with the rest bar and is detachably mounted on a mounting surface that runs parallel to the roll axis. In an arrangement designed in this way, the medium pressure would act on the water stripper along its full length, so that a contact line would form, and thus even a grooved roll could be stripped. The contact pressure could be maintained independently of the frictional wear. Very exact adjustment of the mounting strip would be eliminated. Moreover, a minimum number of parts would be necessary. In a design modification, the pressure medium is supplied by means of a compressed air connection into a groove on the rear side of the water stripper, where the end of the shaped cross section terminates with a sealing lip, in whose groove the pressure medium is introduced.

KR 1020040092252 A discloses a stripping device with a shielding device for preventing uneven cooling of a strip by spray water. The arrangement described in the cited document serves the purpose of providing a stripping device with a shielding device to prevent uneven cooling of a strip by spray water. This device can be mounted on the frame of a finishing mill of a hot rolling mill to prevent spraying or leaking water from dripping onto the surface of the rolling stock to be rolled. In this regard, the stripping device comprises a front and rear moving part with a large number of racks, which can move forwards and backwards towards the side of the roll on an upper surface of a stripper base, where a stripper arm is mounted on a front part of the stripper base, and, in addition, driving pinions are provided, which engage the racks to move them forwards and backwards. In addition, a pneumatic motor is provided to move the racks backwards and forwards by the rotation of the driving pinion. Also provided is an additional shield, which lies in front of the racks and is moved back and forth, where a front part of this additional shield lies tightly against the roll on an upper part of the stripper arm in order to seal mainly cooling water from a plurality of nozzles for cooling the roll. Also provided is a mounting part, by which the additional shield is connected with the front part of the racks, in such a way that a front part of the additional shield is in linear contact with the roll and lies tightly and elastically against the roll in conformity with a change in the roll gap between the rolls due to spring action as a function of the diameter of the roll and the thickness of the rolling stock.

As noted above, in the previously known arrangements, it is especially disadvantageous that the sealing elements that are used are subject to increased wear and short service lives.

Taking this prior art as a point of departure, the objective of the invention is to improve or refine the previously known arrangements in such a way that their advantages are retained and simple means are employed to remove media, such as roll cooling water, emulsion, etc., before they drip down between the inlet/outlet guide and the rolls/roll fittings. Moreover, the desired arrangement should have a design that is as simple as possible and should be subject to the least possible wear.

In accordance with the invention, this objective is achieved by virtue of the fact that the sealing means for preventing the medium from dripping down, especially onto the rolling stock, is designed as at least one sealing strip arranged between the rest bar and the inlet/outlet guide.

In this way, simple means are employed for the first time in a rolling stand of this type, in which media, such as roll cooling water, emulsion, etc., are removed before they can drip down between the inlet/outlet guide and the rolls/roll fittings. In this regard, when contact pressure is applied to the inlet/outlet guide, the gap between the rest bar and the inlet/outlet guide is sealed by the sealing strip, so that the aforesaid media are prevented from dripping onto the rolling stock. The arrangement of the invention provides an especially favorable solution that is also robust and reliable and is subject to very little wear.

In the preferred embodiment of the present invention, the sealing strip is mounted in a mounting groove located in the area between the rest bar and the inlet/outlet guide. In a preferred modification, the mounting groove is located in the rest bar. This is an embodiment with a simple design, in which the sealing strip can be pressed out of the mounting groove in a simple way to perform its sealing function.

In accordance with another modified feature of the present invention, it is provided that the sealing strip is supported in the mounting groove in such a way that it is pretensioned against the rest bar. The sealing strip thus fulfills the required sealing function between the inlet/outlet guide and the rest bar without any additional adjustment operations. In this regard, it is recommended that at least one spring mechanism be provided for pretensioning the sealing strip in the mounting groove. In this regard, when contact pressure is applied to the inlet/outlet guide by this spring mechanism, the gap between the rest bar and the inlet/outlet guide is sealed by the spring-loaded sealing strip, so that the aforesaid media are prevented from dripping onto the rolling stock.

However, in a modification of the rolling stand of the invention which deviates from the above modification, a pneumatic system or a hydraulic system is provided for pretensioning the sealing strip in the mounting groove.

In accordance with another modified feature of the present invention, it is recommended that the arrangement of the sealing strip in the mounting groove includes a retaining device for the sealing strip, by which, if desired, the sealing strip can be held in an inoperative position. In a preferred modification involving a final feature of the present invention, it is provided that the retaining device for the sealing strip mounted in the mounting groove takes the form of at least one screw.

A specific embodiment of the invention is illustrated in the drawings.

Figure 1:
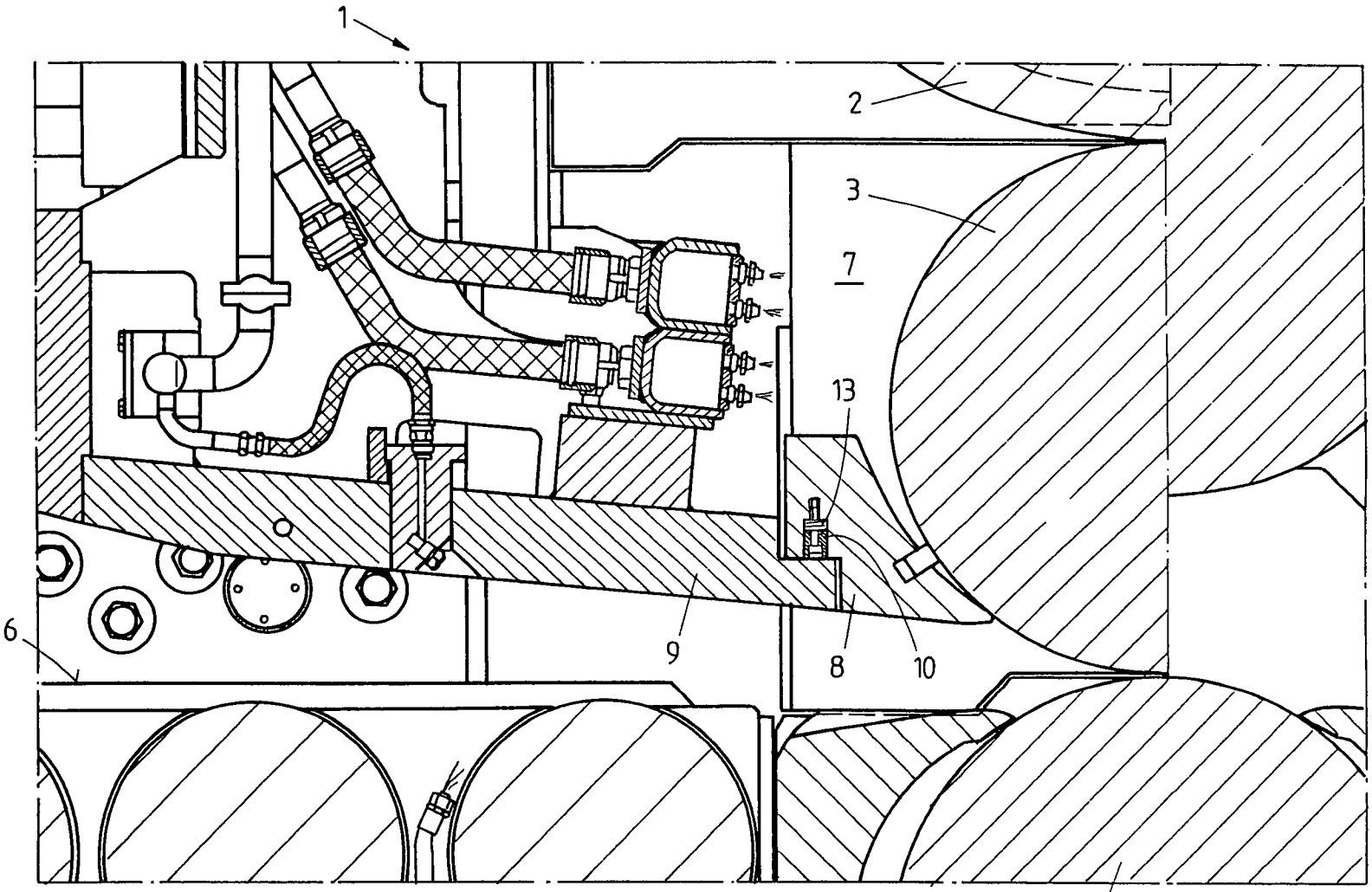
FIG. 1 shows a schematic partial side view of the rolling stand of the invention with the sealing strip mounted between the rest bar and the inlet/outlet guide.

The rolling stand of the invention is generally designated by reference number 1. The rolling stand 1 is equipped with backup rolls and/or work rolls (2, 3, 4, 5) and is used for rolling plate and strip. FIG. 1 shows a partial side view of a rolling stand 1 that comprises an upper work roll 3, a lower work roll 4, an upper backup roll 2, and a lower backup roll 5 (not separately shown). The illustrated embodiment of the rolling stand 1 of the invention (see FIG. 1) includes a rest bar 8, which is mounted between the work roll chocks 7 and is assigned to the upper work roll 3, and an inlet/outlet guide 9 for a medium, e.g., cooling water, emulsion, or the like, which is arranged next to the rest bar 8. The rolling stand 1 of the invention also comprises sealing means 10 for preventing, e.g., cooling water, from dripping onto the rolling stock. In this connection, see FIG. 2, which shows a detail view of the section of the rolling stand 1 that contains the sealing means 10. In the embodiment shown in FIG. 1, the chief design features of a rolling stand 1 are well known to those who are skilled in the art. Therefore, individual design details that are not shown in the drawing or that are only partly shown are not individually described in detail here.

Figure 2:
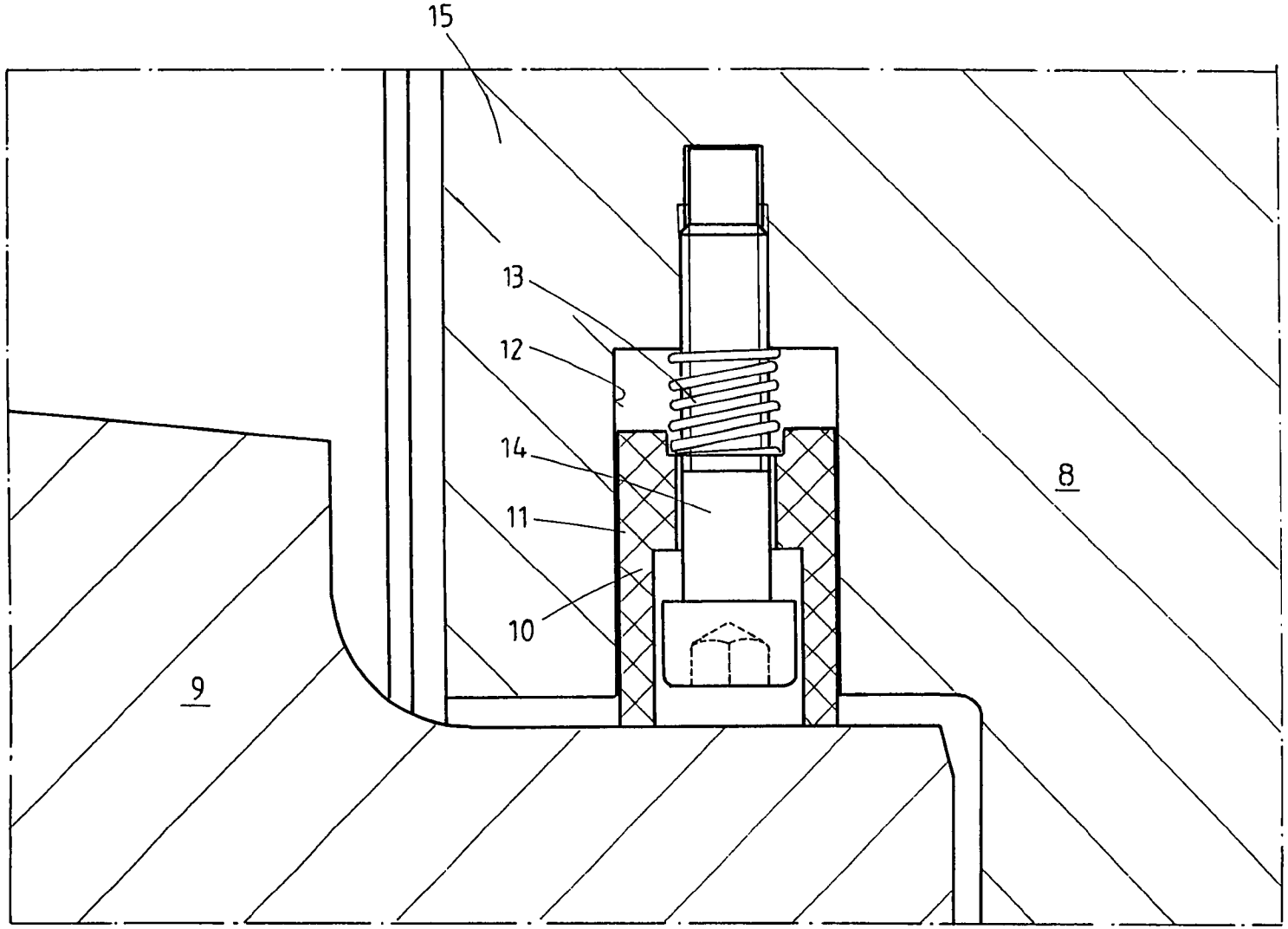
FIG. 2 shows a schematic partial side view of the drawing according to FIG. 1 with the sealing strip mounted between the rest bar and the inlet/outlet guide in detail.

In accordance with the invention, it is provided that, in the rolling stand 1, the sealing means 10 for preventing, e.g., cooling water, from dripping onto the rolling stock are designed as a sealing strip 11 arranged between the rest bar 8 and the inlet/outlet guide 9 in the illustrated embodiment (see especially FIG. 2). These means result for the first time in a rolling stand 1 of this type, in which the medium is prevented from dripping onto the rolling stock by virtue of the fact that when contact pressure is applied to the inlet/outlet guide 9, the gap between the rest bar 8 and the inlet/outlet guide 9 is sealed by the sealing strip 11. The arrangement of the invention provides an especially favorable solution that is also robust and reliable and is subject to very little wear.

In the illustrated embodiment of the arrangement of the invention, it is additionally provided (see FIG. 2) that the sealing strip 11 is mounted in a mounting groove 12 located in the area between the rest bar 8 and the inlet/outlet guide 9. In the example illustrated here, the mounting groove 12 is located in the rest bar 8. Especially from the design standpoint, this is a simple embodiment, in which the sealing strip 11 can be pressed out of the mounting groove 12 in a simple way to perform its sealing function.

In addition, the sealing strip 11 is supported in the mounting groove 12 in such a way that it is pretensioned against the rest bar 8. The sealing strip 11 thus fulfills the required sealing function between the inlet/outlet guide 9 and the rolls/roll fittings without any additional adjustment operations. In this regard, a spring mechanism 13 is provided for pretensioning the sealing strip 11 in the mounting groove 12 (see FIG. 2). In this regard, when contact pressure is applied to the inlet/outlet guide 9 by this spring mechanism 13, the gap between the rest bar 8 and the inlet/outlet guide 9 is sealed precisely by the spring-loaded sealing strip 11, so that the aforesaid media are prevented from dripping onto the rolling stock. However, as an alternative to the spring mechanism, it is also possible to provide a pneumatic system or a hydraulic system for pretensioning the sealing strip 11 in the mounting groove 12. In addition, it is possible to provide other types of devices or systems for developing the pretension.

In the rolling stand 1 of the invention, it is additionally provided (see FIG. 2) that the arrangement of the sealing strip 11 in the mounting groove 12 includes a retaining device 14 for the sealing strip 11, by which, if desired, the sealing strip 11 can be held in an inoperative position and is prevented from falling out. This retaining device 14 for the sealing strip 11 mounted in the mounting groove 12 takes the form of a screw 15 in the present example.

LIST OF REFERENCE NUMBERS

1 rolling stand
2 upper backup roll
3 upper work roll
4 lower work roll
5 lower backup roll
6 plate (rolling stock)
7 work roll chock
8 rest bar
9 inlet/outlet guide
10 sealing means (between 8 and 9)
11 sealing strip
12 mounting groove (for 11)
13 spring mechanism (in 12 for 11)
14 retaining device (for 11 in 12)
15 screw

The invention claimed is:

1. A rolling stand (1), comprising:

backup rolls and/or work rolls (2, 3, 4, 5) for rolling plate (6) or strip, with at least one rest bar (8), which is arranged between chocks (7) of one of the rolls and preferably is assigned to the upper roll (3);

an inlet/outlet guide (9) for a cooling medium arranged next to the rest bar (8);

and sealing means (10) for preventing the medium from dripping down onto the rolling stock, wherein the sealing means (10) for preventing the medium from dripping down is designed as at least one sealing strip (11) arranged between a downwardly-facing, substantially horizontal surface of the rest bar (8) and an upwardly-facing, substantially horizontal surface of the inlet/outlet guide (9).

2. A rolling stand in accordance with claim 1, wherein the sealing strip (11) is mounted in a mounting groove (12) located in the area between the rest bar (8) and the inlet/outlet guide (9).

3. A rolling stand in accordance with claim 2, wherein the sealing strip (11) is supported in the mounting groove (12) in a pretensioned state.

4. A rolling stand in accordance with claim 3, wherein at least one spring mechanism (13) is provided for pretensioning the sealing strip (11) in the mounting groove (12).

5. A rolling stand in accordance with claim 3, wherein a pneumatic system is provided for pretensioning the sealing strip (11) in the mounting groove (12).

6. A rolling stand in accordance with claim 3, wherein a hydraulic system is provided for pretensioning the sealing strip (11) in the mounting groove (12).

7. A rolling stand in accordance with claim 2, wherein the arrangement of the sealing strip (11) in the mounting groove (12) includes a retaining device (14) for the sealing strip (11).

8. A rolling stand in accordance with claim 7, wherein the retaining device (14) for the sealing strip (11) mounted in the mounting groove (12) takes the form of at least one screw (15).

* * * * *